US008843038B2

(12) United States Patent
Ogata

(10) Patent No.: US 8,843,038 B2
(45) Date of Patent: Sep. 23, 2014

(54) IMAGE FORMING APPARATUS, IMAGE FORMING METHOD, AND COMPUTER READABLE MEDIUM

(71) Applicant: Fuji Xerox Co., Ltd., Tokyo (JP)

(72) Inventor: Kenta Ogata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 79 days.

(21) Appl. No.: 13/743,856

(22) Filed: Jan. 17, 2013

(65) Prior Publication Data

US 2014/0093285 A1 Apr. 3, 2014

(30) Foreign Application Priority Data

Sep. 28, 2012 (JP) ..... 2012-216804

(51) Int. Cl.
*G03G 15/01* (2006.01)

(52) U.S. Cl.
CPC ..... *G03G 15/0105* (2013.01)
USPC ..... 399/301

(58) Field of Classification Search
USPC ..... 399/301
See application file for complete search history.

(56) References Cited

U.S. PATENT DOCUMENTS

| | | | | |
|---|---|---|---|---|
| 7,715,768 | B2 * | 5/2010 | Shinohara | 399/301 |
| 7,986,907 | B2 * | 7/2011 | Miyadera | 399/301 |
| 8,010,026 | B2 * | 8/2011 | Kobayashi et al. | 399/301 |
| 8,170,455 | B2 * | 5/2012 | Miyadera | 399/301 |
| 2002/0051648 | A1 | 5/2002 | Shimomura et al. | |
| 2008/0170220 | A1 | 7/2008 | Sawayama et al. | |

FOREIGN PATENT DOCUMENTS

| | | | |
|---|---|---|---|
| JP | 2002-055572 | A | 2/2002 |
| JP | 2002-162803 | A | 6/2002 |
| JP | 2007-047432 | A | 2/2007 |
| JP | 4154272 | B2 | 9/2008 |
| JP | 2011-107524 | A | 6/2011 |

* cited by examiner

*Primary Examiner* — Sandra Brase
(74) *Attorney, Agent, or Firm* — Sughrue Mion, PLLC

(57) ABSTRACT

An image forming apparatus includes first and second detection units, first to third image forming units, and first to third specifying units. The first and second detection units receive light reflected from first and second regions irradiated with first light and second light having a small range compared with the first light, and detect light-amount signals. The first image forming unit forms first images at first intervals in a first portion passing through the first region. The second image forming unit forms second images having a short length compared with the first images, at second intervals shorter than the first intervals, in a second portion passing through the second region. The third image forming unit forms a third image in the first portion. The first and second specifying units specify misregistration amounts in the first and second images. The third specifying unit specifies density deviation amounts in the third images.

19 Claims, 5 Drawing Sheets

IMAGE FORMING APPARATUS, IMAGE FORMING METHOD, AND COMPUTER READABLE MEDIUM

CROSS-REFERENCE TO RELATED APPLICATIONS

This application is based on and claims priority under 35 USC 119 from Japanese Patent Application No. 2012-216804 filed Sep. 28, 2012.

BACKGROUND

Technical Field

The present invention relates to an image forming apparatus, an image forming method, and a computer-readable medium.

SUMMARY

According to an aspect of the invention, there is provided an image forming apparatus including a first detection unit, at least one second detection unit, a first image forming unit, a second image forming unit, a third image forming unit, a first specifying unit, a second specifying unit, and a third specifying unit. The first detection unit receives first reflected light reflected from a first region irradiated with first irradiation light and detects a signal indicating the amount of the first reflected light. The at least one second detection unit receives second reflected light reflected from a second region irradiated with second irradiation light having an irradiation range smaller than an irradiation range of the first irradiation light, and detects a signal indicating the amount of the second reflected light. The first image forming unit forms multiple first images having a predetermined length in a predetermined direction, in a first portion of a medium moving in the predetermined direction. The first portion passes through the first region. The first images are spaced apart from each other at predetermined first intervals in the predetermined direction. The second image forming unit forms multiple second images having a length in the predetermined direction which is shorter than the length of the first images, in a second portion of the medium. The second portion passes through the second region. The second images are spaced apart from each other at second intervals shorter than the first intervals in the predetermined direction. The third image forming unit forms a third image used to specify density deviation amounts by using a predetermined density as a reference, in the first portion. The first specifying unit specifies a misregistration amount of the first images formed in the first portion, on the basis of the signal detected by the first detection unit when the first images pass through the first region. The second specifying unit specifies a misregistration amount of the second images formed on the second portion, on the basis of the signal detected by the at least one second detection unit when the second images pass through the second region. The third specifying unit specifies the density deviation amounts on the basis of the signal detected by the first detection unit when the third image passes through the first region.

BRIEF DESCRIPTION OF THE DRAWINGS

Exemplary embodiments of the present invention will be described in detail based on the following figures, wherein.

DETAILED DESCRIPTION

1. Exemplary Embodiment

1-1. Entire Configuration of Image Forming Apparatus

Figure 1:
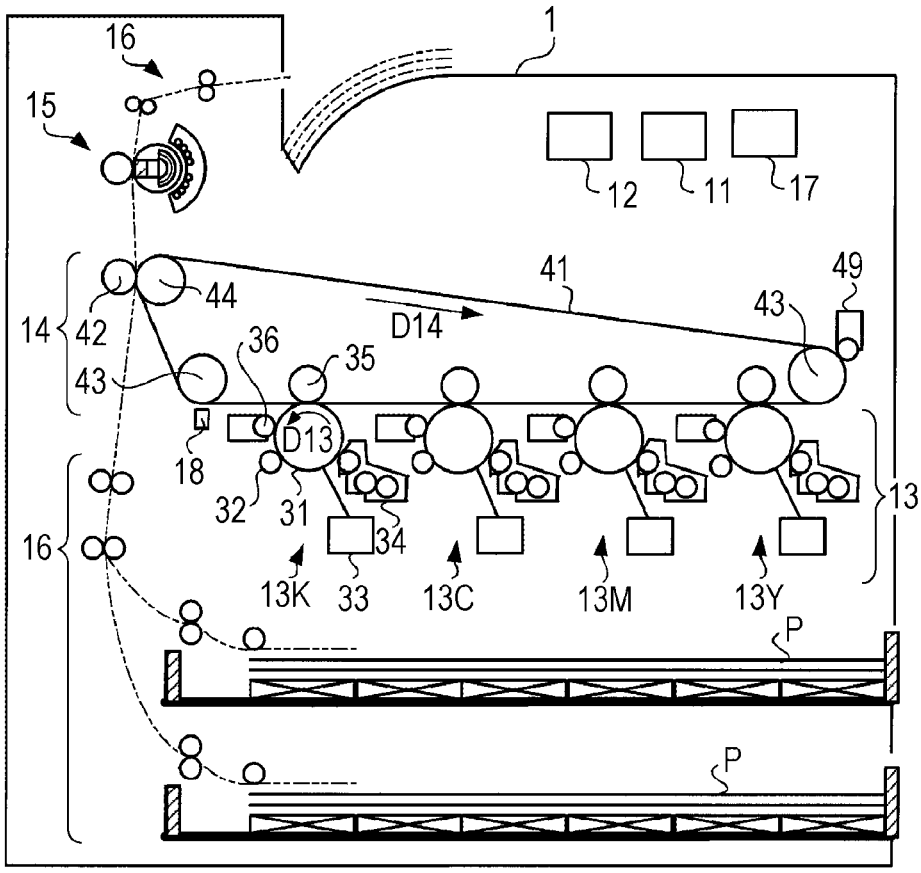
FIG. 1 is a diagram illustrating the entire configuration of an image forming apparatus according to an exemplary embodiment.

FIG. 1 is a diagram illustrating the entire configuration of an image forming apparatus 1 according to an exemplary embodiment. As illustrated in FIG. 1, the image forming apparatus 1 includes a controller 11, a storage unit 12, development units 13Y, 13M, 13C, and 13K, a transfer unit 14, a heating unit 15, a transport unit 16, an operation unit 17, and a detection unit 18. The symbols 'Y', 'M', 'C', and 'K' indicate configurations corresponding to toners of yellow, magenta, cyan, and black, respectively. The development units 13Y, 13M, 13C, and 13K are not distinctly different from each other except that they use different toners. Hereinafter, when it is not necessary to distinguish the development units 13Y, 13M, 13C, and 13K from each other particularly, the last character of the reference characters which indicates the color of a toner is omitted, and the term "development unit 13" is used.

The controller 11 includes a central processing unit (CPU), a read only memory (ROM), and a random access memory (RAM). The CPU reads out computer programs (hereinafter, simply referred to as programs) stored in the ROM or the storage unit 12, and executes them, thereby controlling units of the image forming apparatus 1.

The operation unit 17 includes operators such as operation buttons for providing various instructions. The operation unit 17 receives operations performed by a user, and supplies signals according to the operations to the controller 11.

The storage unit 12 is a large-capacity storage unit such as a hard disk drive, and stores programs which are read out by the CPU of the controller 11. In addition to various data such as image data which indicates an image to be formed on a medium, the storage unit 12 stores image data which indicates images for detecting misregistration and image data which indicates images for detecting density deviation.

The transport unit 16 includes containers and transport rolls. Each container contains sheets of paper P, each of which is manufactured by cutting paper into a predetermined size and is used as a medium. The sheets of paper P contained in a container are taken out one by one by the transport rolls in accordance with an instruction from the controller 11, and are transported via a sheet transport path to the transfer unit 14. The medium is not limited to a sheet of paper, and may be, for example, a sheet made of resin. In short, any medium is employable as long as it is possible to record an image on the surface of the medium.

Each of the development units 13 includes a photoconductor drum 31, a charger 32, an exposure apparatus 33, a developing device 34, a first transfer roll 35, and a drum cleaner 36. The photoconductor drum 31 is an image carrier including a charge producing layer and a charge transport layer, and is rotated by a driving unit (not illustrated) in the direction indicated by an arrow D13 in FIG. 1. The charger 32 charges the surface of the photoconductor drum 31. The exposure apparatus 33 includes a laser optical source and a polygon mirror (both are not illustrated), and irradiates the photoconductor drum 31 which has been charged by the charger 32, with laser beams according to image data under control of the controller 11. Thus, each of the photoconductor drums 31 carries a latent image. The above-described image data may be data obtained by the controller 11 from an external apparatus via a communication unit (not illustrated). An external apparatus is, for example, a reading apparatus which reads out an original image or a storage device which stores data indicating an image.

The developing device 34 contains a developer including a toner of any one of the colors of Y, M, C, and K. The toner supplied from the developing device 34 is adhered to portions, i.e., printing elements in an electrostatic latent image, on the surface of the photoconductor drum 31 which are exposed by the exposure apparatus 33, and an image is formed (developed) on the photoconductor drum 31.

The first transfer roll 35 produces a predetermined potential difference at a position where an intermediate transfer belt 41 of the transfer unit 14 faces the photoconductor drum 31, and the potential difference causes an image to be transferred to the intermediate transfer belt 41. The drum cleaner 36 removes toner which has not been transferred and which remains on the surface of the photoconductor drum 31 after the image is transferred, and eliminates the charge on the surface of the photoconductor drum 31.

The transfer unit 14 includes the intermediate transfer belt 41, a second transfer roll 42, belt transport rolls 43, and a backup roll 44, and transfers an image formed by the development units 13 onto a sheet of paper P of a type determined in accordance with an operation by a user. The intermediate transfer belt 41 is an endless belt member which has a loop shape. The belt transport rolls 43 and the backup roll 44 cause the intermediate transfer belt 41 to be stretched. At least one of the belt transport rolls 43 and the backup roll 44 includes a driving unit (not illustrated) which causes the intermediate transfer belt 41 to be moved in the direction indicated by an arrow D14 in FIG. 1. That is, the intermediate transfer belt 41 moves in the arrow D14 direction which is a circumferential direction of the loop. A belt transport roll 43 or the backup roll 44 which does not include a driving unit is rotated in accordance with the move of the intermediate transfer belt 41. The intermediate transfer belt 41 moves and turns in the arrow D14 direction in FIG. 1, whereby an image on the intermediate transfer belt 41 is moved to a region between the second transfer roll 42 and the backup roll 44.

The second transfer roll 42 transfers an image on the intermediate transfer belt 41 onto a sheet of paper P transported from the transport unit 16, by using a potential difference between the second transfer roll 42 and the intermediate transfer belt 41. A belt cleaner 49 removes toner which has not been transferred and which remains on the surface of the intermediate transfer belt 41. Then, the transfer unit 14 or the transport unit 16 transports the sheet of paper P on which the image has been transferred, to the heating unit 15. The development units 13 and the transfer unit 14 are exemplary image forming units which form an image on a medium in the present invention. The heating unit 15 melts the toner through heating, and fixes the image transferred onto the sheet of paper P. The sheet of paper P on which the image is fixed by the heating unit 15 is transported by the transport unit 16 to a paper output location located outside of the housing of the image forming apparatus 1.

The detection unit 18 irradiates, with light, images for detecting density deviation or images for detecting misregistration which are formed on the intermediate transfer belt 41, and receives the reflected light, thereby specifying density deviation amounts or misregistration amounts on the basis of the received light. The detection unit 18 is disposed downstream of the four development units 13 and upstream of a region in which the intermediate transfer belt 41 is interposed between the second transfer roll 42 and the backup roll 44, in such a manner as to face the intermediate transfer belt 41.

1-2. Configuration of Detection Unit

Figure 2:
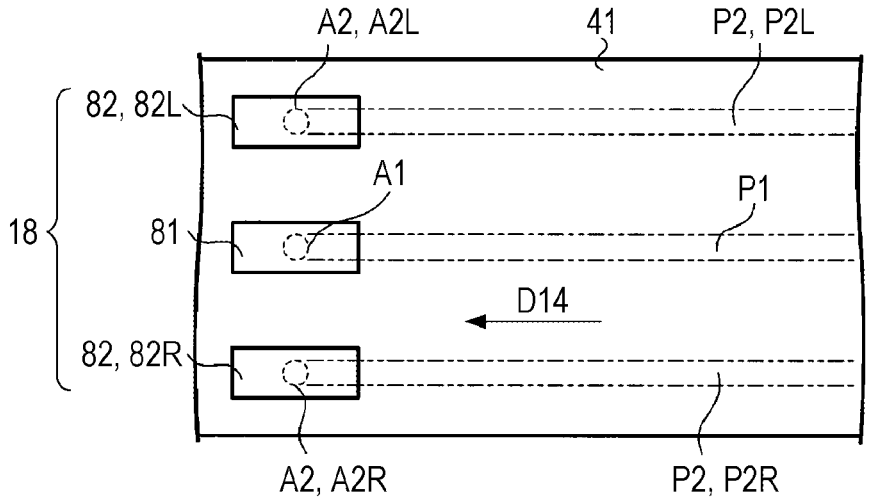
FIG. 2 is a diagram illustrating the locations of components in a detection unit.

FIG. 2 is a diagram illustrating the locations of components in the detection unit 18. The detection unit 18 includes detection units that are disposed at three respective positions which are aligned in a direction which is substantially perpendicular to the arrow D14 direction which is the moving direction of the intermediate transfer belt 41. There are two types of detection units, a first detection unit 81 and a second detection unit 82. The first detection unit 81 specifies misregistrations amounts and also specifies misregistration amounts. The second detection unit 82 specifies misregistration amounts.

A first detection unit 81 is disposed at the center in the width direction of the intermediate transfer belt 41. One second detection unit 82 is disposed on the right side of the center in the width direction of the intermediate transfer belt 41, and the other is disposed on the left side. That is, the first detection unit 81 is disposed at a position close to the center in the width direction of the intermediate transfer belt 41, compared with both of the second detection units 82.

The first detection unit 81 disposed at a position opposing the center in the width direction of the intermediate transfer belt 41 irradiates a first region A1 on the surface of the intermediate transfer belt 41 with light, and specifies misregistration amounts and density deviation amounts on the basis of, for example, the amount of reflected light.

A second detection unit 82 (82R) disposed at a position opposing the right side in the width direction of the intermediate transfer belt 41 irradiates a second region A2 (A2R) on the surface of the intermediate transfer belt 41 with light, and specifies misregistration amounts on the basis of, for example, the amount of reflected light.

A second detection unit 82 (82L) disposed at a position opposing the left side in the width direction of the intermediate transfer belt 41 irradiates a second region A2 (A2L) on the surface of the intermediate transfer belt 41 with light, and specifies misregistration amounts on the basis of, for example, the amount of reflected light.

The intermediate transfer belt 41 is a medium (transfer medium) having a surface on which an image is transferred. The intermediate transfer belt 41 is moved by the above-described driving unit (not illustrated) in the arrow D14 direction in FIG. 2, and passes at the position opposing the detection unit 18. A portion in the intermediate transfer belt 41 which passes the first region A1 is a first portion P1 illustrated in FIG. 2. Portions in the intermediate transfer belt 41 which pass the second regions A2 (A2L, A2R) are second portions P2 (P2L, P2R) illustrated in FIG. 2.

Figure 3A:
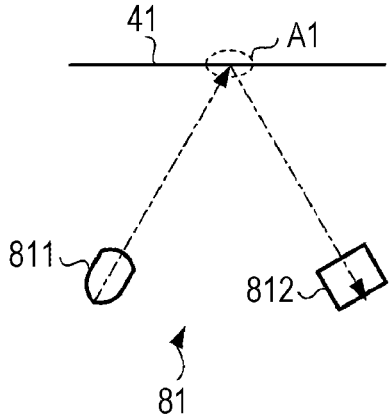
FIGS. 3A and 3B are diagrams for describing differences between a first detection unit and a second detection unit.
Figure 3B:
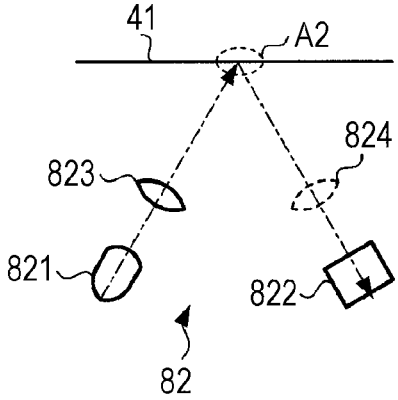

FIGS. 3A and 3B are diagrams for describing differences between the first detection unit 81 and the second detection unit 82. As illustrated in FIG. 3A, the first detection unit 81 includes a first irradiation unit 811 which irradiates the first region A1 with first irradiation light, and a first photodetector 812 which receives light reflected from the first region A1 and which detects a signal indicating the received light amount. The first irradiation unit 811 is, for example, a light emitting diode (LED). The first photodetector 812 is, for example, a photodiode (PD). The first photodetector 812 is disposed on the optical path of specular reflected light which is produced when the first irradiation light emitted from the first irradiation unit 811 is reflected on the first region A1.

The second detection unit 82 is different from the first detection unit 81 in that the second detection unit 82 includes an optical system disposed between an irradiation unit and an irradiated region. As illustrated in FIG. 3B, the second detection unit 82 includes a second irradiation unit 821 which irradiates the second region A2 with second irradiation light, and a second photodetector 822 which receives light reflected from the second region A2 and which detects a signal indicating the received light amount. The second detection unit 82 also includes a condenser 823 which is disposed between the second irradiation unit 821 and the second region A2 and which is an optical system which reduces the light diameter of the second irradiation light through condensing. The second irradiation unit 821 is, for example, an LED. The second photodetector 822 is, for example, a photodiode. The second photodetector 822 is disposed on the optical path of specular reflected light which is produced when the second irradiation light emitted from the second irradiation unit 821 is reflected on the second region A2. The condenser 823 is, for example, a lens, an aperture, or a combination of these. The irradiation range of the second irradiation light which is condensed by the condenser 823 is narrower than that of the first irradiation light.

Figure 4:
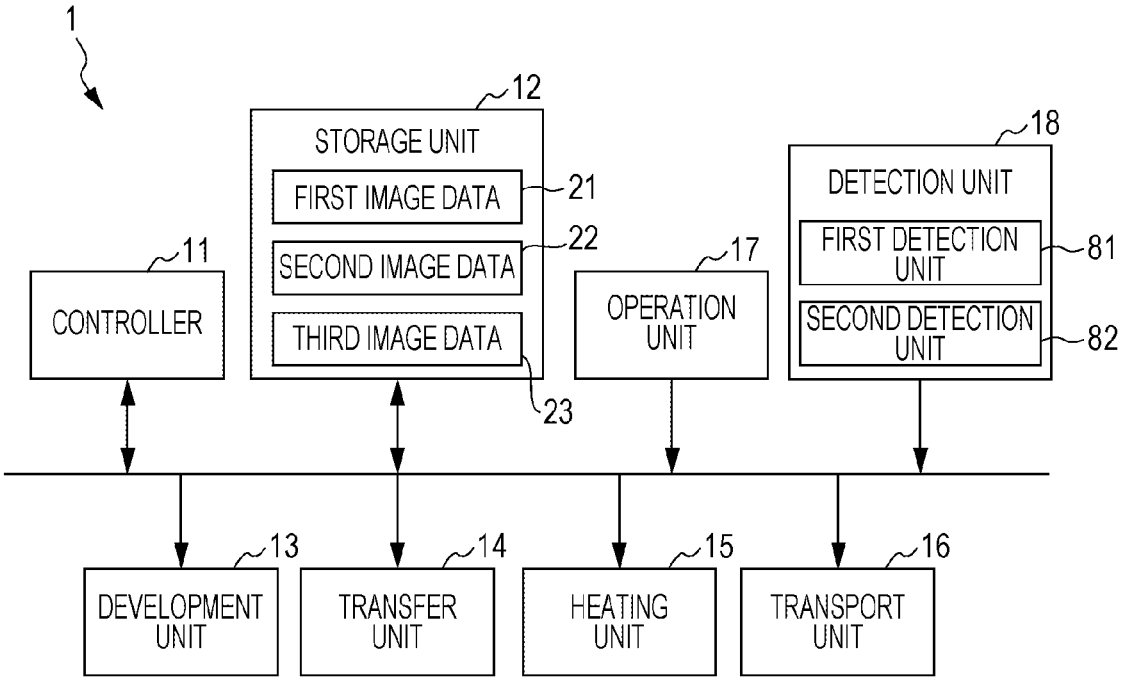
FIG. 4 is a block diagram illustrating the configuration of the image forming apparatus.

FIG. 4 is a block diagram illustrating the configuration of the image forming apparatus 1. As illustrated in FIG. 4, the controller 11 of the image forming apparatus 1 controls the storage unit 12, the development unit 13, the transfer unit 14, the heating unit 15, the transport unit 16, the operation unit 17, and the detection unit 18. The storage unit 12 stores first image data 21, second image data 22, and third image data 23. Misregistration amounts are specified by using the marks-on-belt (MOB) method in which images formed on the surface of the intermediate transfer belt 41 are detected, and the controller 11 controls a development unit 13 to adjust the position of an electrostatic latent image that is to be exposed by the exposure apparatus 33, on the surface of the photoconductor drum 31 on the basis of a specified misregistration amount. That is, the controller 11 functions as a position adjustment unit which adjusts the position of an image to be formed on a medium, on the basis of a specified misregistration amount.

The first image data 21 and the second image data 22 are image data indicating images for specifying misregistration amounts in an image formed on the surface of the intermediate transfer belt 41.

The third image data 23 is image data indicating images used for specifying density deviation amounts by using a predetermined density as a reference. A specified density deviation amount is used for automatic density control so that the optical density of an image to be formed is adjusted. In the automatic density control, the controller 11 of the image forming apparatus 1 causes the chargers 32 to charge the photoconductor drums 31 to a predetermined potential uniformly, and causes the exposure apparatuses 33 to create so-called density reference patches at a potential used as a reference. After the density reference patches are developed by the developing devices 34, the detection unit 18 detects their optical densities. Then, the controller 11 controls parameters for determining an image density, such as a toner density in a developer, a developing bias, an exposure amount, and a charge amount, in accordance with the detection results. That is, the controller 11 functions as a density adjustment unit which adjusts the density of an image formed on a medium on the basis of the specified density deviation amounts. An image in the third image data 23 is formed, for example, by filling a rectangle, 20 mm each side, with a toner having the reference density.

1-3. Configuration of Image Data

Figure 5A:
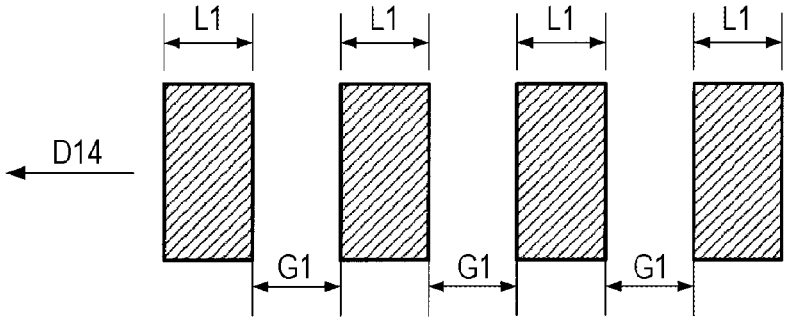
FIGS. 5A and 5B are diagrams illustrating images in first image data and second image data.
Figure 5B:
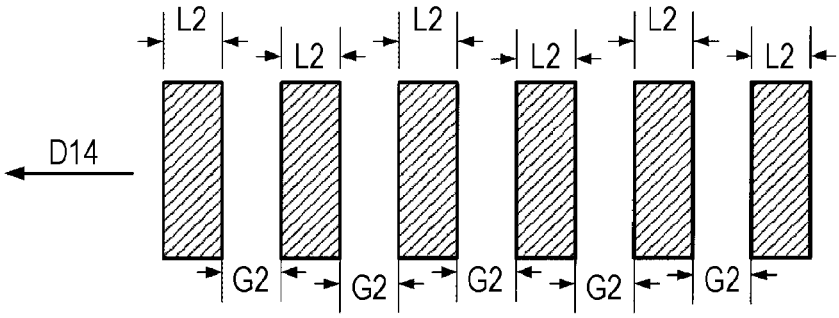

FIGS. 5A and 5B are diagrams illustrating images in the first image data 21 and the second image data 22. Each of four rectangles illustrated in FIG. 5A is an image indicated by the first image data 21 (hereinafter, referred to as a first image). A first image has a length of L1 in the arrow D14 direction which is the moving direction of the intermediate transfer belt 41. The development units 13 form multiple first images on the surface of the intermediate transfer belt 41 of the transfer unit 14 in the arrow D14 direction in such a manner that the first images are spaced apart from each other at predetermined first intervals G1.

Each of six rectangles illustrated in FIG. 5B is an image indicated by the second image data 22 (hereinafter, referred to as a second image). A second image has a length of L2 in the arrow D14 direction which is the moving direction of the intermediate transfer belt 41. The length L2 of a second image in the arrow D14 direction is shorter than the length L1 of a first image. For example, the length L1 is 1.5 mm, and the length L2 is 1.0 mm.

The development units 13 form multiple second images on the surface of the intermediate transfer belt 41 of the transfer unit 14 in the arrow D14 direction in such a manner that the second images are spaced apart from each other at predetermined second intervals G2. A second interval G2 between second images in the arrow D14 direction is shorter than a first interval G1 between first images. For example, the first interval G1 is 1.5 mm, and the second interval G2 is 1.0 mm.

1-4. Functional Configuration of Image Forming Apparatus

Figure 6:
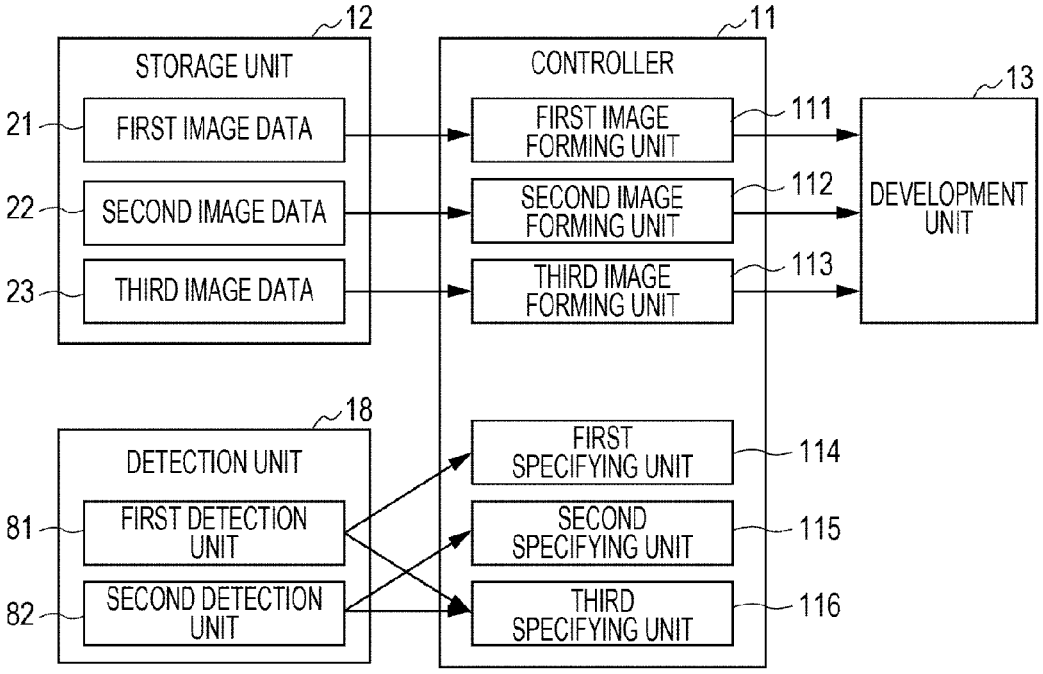
FIG. 6 is a diagram illustrating the functional configuration of the image forming apparatus.

FIG. 6 is a diagram illustrating the functional configuration of the image forming apparatus 1. The controller 11 functions as a first image forming unit 111, a second image forming unit 112, a third image forming unit 113, a first specifying unit 114, a second specifying unit 115, and a third specifying unit 116.

The first image forming unit 111 controls the development units 13 to form multiple first images having a predetermined length in a predetermined direction, in a first portion that is included in a medium moving in the predetermined direction and that passes through a first region, in such a manner that the first images are spaced apart from each other at first intervals in the predetermined direction. That is, the first image forming unit 111 and the development units 13 form the first images having the length L1 in the arrow D14 direction, in the first portion P1 that is included in the intermediate transfer belt 41 which is a transfer medium moving in the arrow D14 direction as illustrated in FIG. 1 and that passes through the first region A1 as illustrated in FIG. 2, in such a manner that the first images are spaced apart from each other at the first intervals G1 in the arrow D14 direction (see FIG. 5A).

The second image forming unit 112 controls the development units 13 to form multiple second images having a length shorter than that of a first image in the moving direction of the above-described medium, in a second portion that is included in the medium and that passes through a second region, in such a manner that the second images are spaced apart from each other at second intervals shorter than the first intervals in the moving direction. That is, the second image forming unit 112 and the development units 13 form the second images having the length L2 shorter than the length L1 of the first images in the arrow D14 direction, in the second portions P2 that are included in the intermediate transfer belt 41 moving in the arrow D14 direction as illustrated in FIG. 1 and that pass through the second regions A2 as illustrated in FIG. 2, in such a manner that the second images are spaced apart from each other at the second intervals G2 shorter than the first intervals G1 in the arrow D14 direction (see FIG. 5B).

The third image forming unit 113 controls the development units 13 to form third images used for specifying density deviation amounts by using a predetermined density as a reference, in the first portion P1.

The first specifying unit 114 specifies misregistration amounts of the images formed in the first portion P1, on the basis of a signal detected by the first detection unit 81 when the multiple first images pass through the first region A1.

The second specifying unit 115 specifies misregistration amounts of the images formed in the second portions P2, on the basis of signals detected by the second detection units 82 when the multiple second images pass through the second regions A2.

The third specifying unit 116 specifies density deviation amounts on the basis of a signal detected by the first detection unit 81 when the third images pass through the first region A1.

1-5. Operations of Image Forming Apparatus

Figure 7:
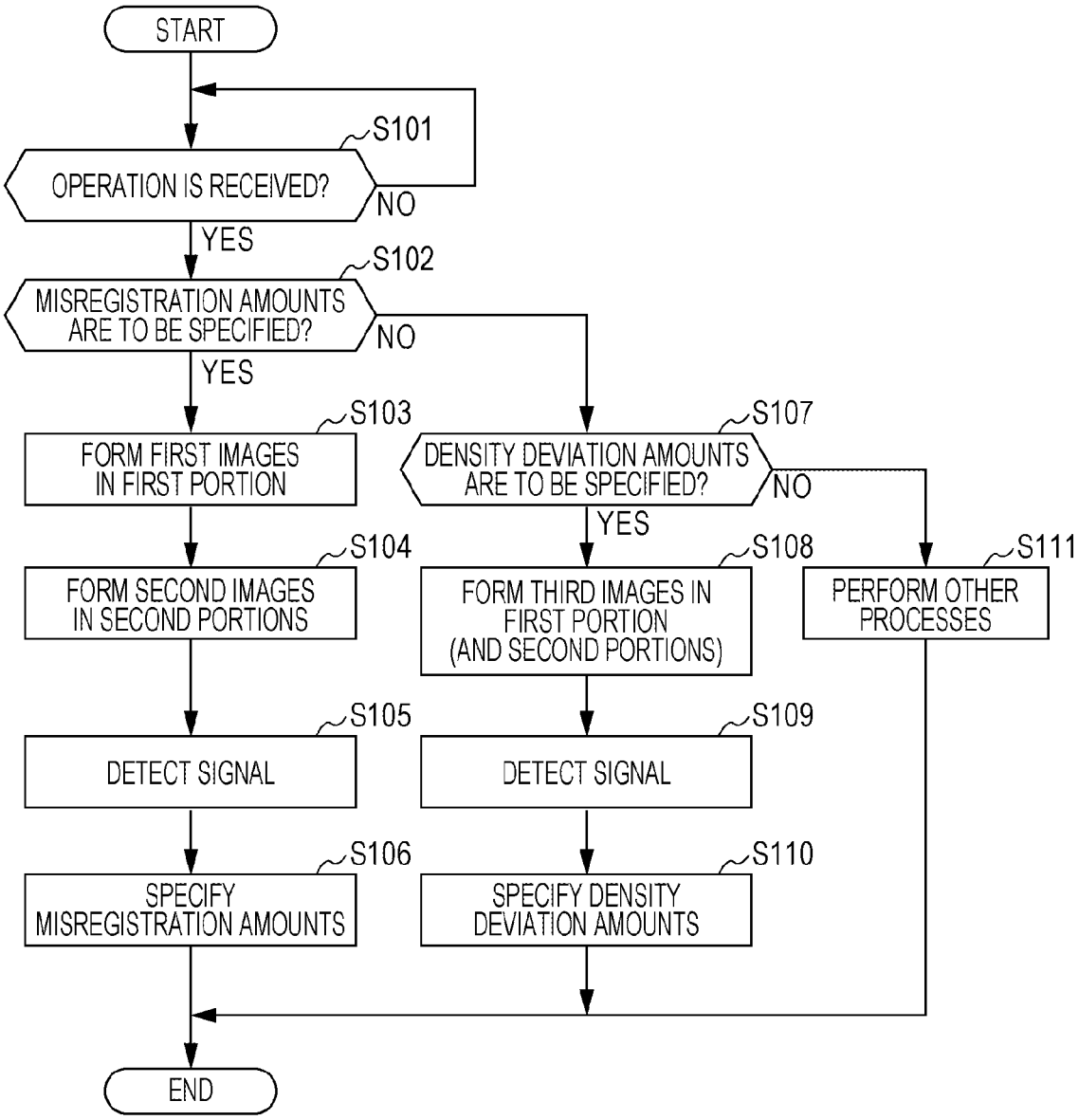
FIG. 7 is a flowchart for describing the flow of operations of the image forming apparatus.

FIG. 7 is a flowchart for describing the flow of operations of the image forming apparatus 1. The controller 11 of the image forming apparatus 1 tries to receive a user operation through the operation unit 17, and determines whether or not an operation has been received (in step S101). If an operation has not been received (NO in step S101), the controller 11 continues to perform this determination. If an operation has been received (YES in step S101), the controller 11 determines whether or not the operation indicates an instruction that misregistration amounts are to be specified (in step S102). If the received operation is determined to indicate an instruction that misregistration amounts are to be specified (YES in step S102), the controller 11 reads out the first image data 21 from the storage unit 12, and controls the development units 13 to form multiple first images based on the first image data 21 in the first portion P1 of the intermediate transfer belt 41 of the transfer unit 14 as illustrated in FIG. 2 (in step S103). The first images having the length L1 in the moving direction of the intermediate transfer belt 41 are formed so as to be spaced apart from each other at the first intervals G1 in the moving direction.

The controller 11 also reads out the second image data 22 from the storage unit 12, and controls the development units 13 to form multiple second images based on the second image data 22 in the second portions P2 of the intermediate transfer belt 41 of the transfer unit 14 as illustrated in FIG. 2 (in step S104). The second images having the length L2 shorter than the length L1 in the moving direction of the intermediate transfer belt 41 are formed so as to be spaced apart from each other at the second intervals G2 shorter than the first intervals G1 in the moving direction. The order of the execution of steps S103 and S104 may be opposite.

When the first portion P1 in which the first images are formed passes through the first region A1, the controller 11 causes the first detection unit 81 to detect a signal indicating the received light amount. When the second portions P2 in which the second images are formed pass through the second regions A2, the controller 11 causes the second detection units 82 to detect signals indicating the received light amounts (in step S105). Then, the controller 11 specifies misregistration amounts of the images formed on the first portion P1 and the second portions P2 on the basis of the signals detected by the first detection unit 81 and the second detection units 82, respectively (in step S106), and the process is ended.

If the operation received through the operation unit 17 is determined not to indicate an instruction that misregistration amounts are to be specified (NO in step S102), the controller 11 determines whether or not this operation indicates an instruction that density deviation amounts are to be specified (in step S107). If the above-described operation is determined not to indicate an instruction that density deviation amounts are to be specified (NO in step S107), the controller 11 performs other processes according to the instruction indicated by the operation (in step S111), and the process is ended.

If the above-described operation is determined to indicate an instruction that density deviation amounts are to be specified (YES in step S107), the controller 11 reads out the third image data 23 from the storage unit 12, and controls the development units 13 to form third images based on the third image data 23 in the first portion P1 of the intermediate transfer belt 41 of the transfer unit 14 as illustrated in FIG. 2 (in step S108). When the first portion P1 in which the third images are formed passes through the first region A1, the controller 11 causes the first detection unit 81 to detect a signal indicating the received light amount (in step S109). Then, the controller 11 specifies density deviation amounts of the images formed on the first portion P1 on the basis of the signal detected by the first detection unit 81 (in step S110), and the process is ended.

As described above, the image forming apparatus 1 includes the detection unit 18 which specifies misregistration amounts and which also specifies density deviation amounts. Accordingly, compared with an image forming apparatus which separately includes a detection unit for specifying misregistration amounts and a detection unit for specifying density deviation amounts, the image forming apparatus 1 requires a small installation space for the detection unit 18. Although the detection unit 18 specifies misregistration amounts and also specifies density deviation amounts, it includes the first detection unit 81 in which importance is placed on the specifying of density deviation amounts and the second detection unit 82 in which importance is placed on the specifying of misregistration amounts. Therefore, it is not necessary to sacrifice precision in specifying of either density deviation amounts or misregistration amounts by placing more importance on one than on the other. In addition, since two types of images for specifying misregistration amounts are provided, a difference hardly occurs in the precision of the misregistration amounts specified by the detection units, compared with a configuration in which only one type of image is provided.

In the above-described exemplary embodiment, since importance is placed on the characteristics of density deviation amounts, only the sensor located at the center, i.e., the first detection unit 81, specifies density deviation amounts. However, the sensors located on the sides, i.e., the second detection units 82, may also specify density deviation amounts. In this case, the above-described third image forming unit 113 may form third images in both of the first portion P1 and the second portions P2. That is, in step S108 described above, the controller 11 may control the development units 13 to form third images in the first portion P1 and the second portions P2 in the intermediate transfer belt 41 of the transfer unit 14.

The third specifying unit 116 may specify density deviation amounts on the basis of a signal detected by the first detection unit 81 when third images pass through the first region A1, and specify density deviation amounts on the basis of signals detected by the second detection units 82 when third images pass through the second regions A2. This enables the period in which the detection unit 18 specifies density deviation amounts to be shortened.

In addition, in the case where the sensor in which importance is placed on the specifying of misregistration amounts, i.e., the second detection unit 82, causes an error in the specifying of density deviation amounts, which is likely to occur especially in a black toner image, the sensor located at the center, i.e., the first detection unit 81, specifies density deviation amounts for all colors including black, and the sensors located on the sides, i.e., the second detection units 82, specify density deviation amounts for colors other than black. This enables the process to be completed in a time period shorter than that for the case in which only the sensor located at the center, i.e., the first detection unit 81, specifies density deviation amounts, and also allows the precision with which density deviation amounts are specified not to be sacrificed.

In the present exemplary embodiment, a cycle (period) in which misregistration amounts are specified and in which the positions of images are adjusted, and a cycle (period) in which density deviation amounts are specified and in which the densities of images are adjusted are set through an operation panel, and the operations are performed. The operations may be automatically performed at a certain timing, for example, when temperature, humidity, or the like is measured and the occurrence of some change in the environment is detected, when the number of sheets of paper which have been used for image formation reaches a threshold, or just after a startup of the image forming apparatus 1.

2. MODIFICATION EXAMPLE

An exemplary embodiment is described above. The exemplary embodiment may be modified as described below. Modification examples described below may be combined together.

2-1. First Modification Example

In the above-described exemplary embodiment, the development units 13 use four types of toners of yellow, magenta, cyan, and black. However, a configuration may be employed in which, for example, only black toner is used. In this case, only one development unit 13 may be used.

2-2. Second Modification Example

In the above-described exemplary embodiment, when an image formed on the surface of the intermediate transfer belt 41 is moved to a predetermined region, the detection unit 18 receives light reflected from the region and detects a signal indicating the received light amount. However, reflected light which is received is not limited to light reflected from a transfer medium such as the intermediate transfer belt 41. For example, the detection unit 18 may specify density deviation amounts and misregistration amounts on a sheet of paper P by irradiating, with light, the images formed on the sheet of paper P which is moving and by receiving the reflected light. In short, any configuration is employable as long as first and second images for specifying misregistration amounts, and third images for specifying density deviation amounts are formed on a medium.

2-3. Third Modification Example

In the above-described exemplary embodiment, the second detection unit 82 includes an optical system located between the irradiation unit and the irradiated region, whereas the first detection unit 81 does not include such an optical system as described above. However, the first detection unit 81 may also include this optical system. In other words, any configuration is employable as long as a narrow irradiation range is achieved for the second irradiation light by reducing the light diameter of the second irradiation light which is emitted from the second irradiation unit 821 of the second detection unit 82 to the second region A2 compared with that of the first irradiation light which is emitted from the first irradiation unit 811 of the first detection unit 81 to the first region A1.

2-4. Fourth Modification Example

In the above-described exemplary embodiment, the second detection unit 82 includes the condenser 823 which reduces the light diameter of second irradiation light through condensing and which is located between the second irradiation unit 821 and the second region A2. In addition, the second detection unit 82 may include a condenser 824 (illustrated using a dashed line in FIG. 3B) which reduces the light diameter of light reflected from the second region A2. In this case, any configuration is employable as long as the condenser 824 is located between the second region A2 and the second photodetector 822. The condenser 824 is, for example, a lens, an aperture, or a combination of these.

2-5. Fifth Modification Example

In the above-described exemplary embodiment, the lengths L1 of first images are uniformly 1.5 mm, whereas the lengths L2 of second images are uniformly 1.0 mm. However, they may be variable. In short, any configuration is employable as long as the shortest length of second images is shorter than the shortest length of first images. In addition, in the above-described exemplary embodiment, the first intervals G1 are uniformly 1.5 mm, whereas the second intervals G2 are uniformly 1.0 mm. However, they may be variable. In short, any configuration is employable as long as the shortest one among the second intervals is shorter than the shortest one among the first intervals.

2-6. Sixth Modification Example

In the above-described exemplary embodiment, the shape of each of the first and second images is a rectangle. However, the shape is not limited to a rectangle. For example, it may be a mountain shape having inclinations in the moving direction of the intermediate transfer belt 41, which is a so-called chevron pattern. That is, the shape of the first and second images may be any as long as the length of a second image in the moving direction of a medium such as the intermediate transfer belt 41 is shorter than that of a first image and the length of a second interval in the moving direction is shorter than that of a first interval.

2-7. Seventh Modification Example

In the above-described exemplary embodiment, the first detection unit 81 is a detection unit which is used to specify density deviation amounts as well as misregistration amounts, and in which importance is placed on the specifying of density deviation amounts compared with the second detection units 82. However, the first detection unit 81 may be used only to specify misregistration amounts. In this case, the third image forming unit 113 may control the development units 13 to form the above-described third images in the second portions, and the third specifying unit 116 may specify density deviation amounts on the basis of signals detected by the second detection units 82 when the third images pass through the second regions A2.

2-8. Eighth Modification Example

Programs executed by the controller 11 of the image forming apparatus 1 may be provided in such a manner as to be stored in a computer-readable recording medium, e.g., a magnetic recording medium, such as a magnetic tape or a magnetic disk, an optical recording medium such as an optical disk, a magneto-optical medium, or a semiconductor memory. Alternatively, for example, the programs may be downloaded via communication lines such as the Internet. Various apparatuses other than a CPU may be employed as a control unit whose example is the above-described controller 11. For example, a dedicated processor may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first detection unit that receives first reflected light reflected from a first region irradiated with first irradiation light and that detects a signal indicating the amount of the first reflected light;

at least one second detection unit that receives second reflected light reflected from a second region irradiated with second irradiation light having an irradiation range smaller than an irradiation range of the first irradiation light, and that detects a signal indicating the amount of the second reflected light;

a first image forming unit that forms a plurality of first images having a predetermined length in a predetermined direction, in a first portion of a medium moving in the predetermined direction, the first portion passing through the first region, the plurality of first images being configured in such a manner as to be spaced apart from each other at predetermined first intervals in the predetermined direction;

a second image forming unit that forms a plurality of second images having a length in the predetermined direction which is shorter than the length of the plurality of first images, in a second portion of the medium, the second portion passing through the second region, the plurality of second images being configured in such a manner as to be spaced apart from each other at second intervals shorter than the first intervals in the predetermined direction;

a third image forming unit that forms a third image used to specify density deviation amounts by using a predetermined density as a reference, in the first portion;

a first specifying unit that specifies a misregistration amount of the plurality of first images formed in the first portion, on the basis of the signal detected by the first detection unit when the plurality of first images pass through the first region;

a second specifying unit that specifies a misregistration amount of the plurality of second images formed on the second portion, on the basis of the signal detected by the at least one second detection unit when the plurality of second images pass through the second region; and a third specifying unit that specifies the density deviation amounts on the basis of the signal detected by the first detection unit when the third image passes through the first region.

2. The image forming apparatus according to claim 1, further comprising:

a position adjustment unit that adjusts the position of an image formed on the medium, on the basis of the misregistration amount specified by the first specifying unit or the second specifying unit.

3. The image forming apparatus according to claim 2, further comprising:

a density adjustment unit that adjusts the density of an image formed on the medium, on the basis of the density deviation amounts specified by the third specifying unit.

4. The image forming apparatus according to claim 3, wherein the at least one second detection unit causes the light diameter of the second reflected light reflected from the second region to be reduced compared with the light diameter of the first reflected light detected by the first detection unit, and receives the second reflected light.

5. The image forming apparatus according to claim 4, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

6. The image forming apparatus according to claim 3, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

7. The image forming apparatus according to claim 2, wherein the at least one second detection unit causes the light diameter of the second reflected light reflected from the second region to be reduced compared with the light diameter of the first reflected light detected by the first detection unit, and receives the second reflected light.

8. The image forming apparatus according to claim 7, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

9. The image forming apparatus according to claim 2, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

10. The image forming apparatus according to claim 1, further comprising:

a density adjustment unit that adjusts the density of an image formed on the medium, on the basis of the density deviation amounts specified by the third specifying unit.

11. The image forming apparatus according to claim 10, wherein the at least one second detection unit causes the light diameter of the second reflected light reflected from the second region to be reduced compared with the light diameter of the first reflected light detected by the first detection unit, and receives the second reflected light.

12. The image forming apparatus according to claim 11, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

13. The image forming apparatus according to claim 10, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

14. The image forming apparatus according to claim 1, wherein the at least one second detection unit causes the light diameter of the second reflected light reflected from the second region to be reduced compared with the light diameter of the first reflected light detected by the first detection unit, and receives the second reflected light.

15. The image forming apparatus according to claim 14, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

16. The image forming apparatus according to claim 1, wherein the medium is an endless medium having a loop shape, and moves in a circumferential direction of the loop, the circumferential direction being used as the predetermined direction, and wherein the first detection unit is disposed at a position closer to the center than the position of the at least one second detection unit in the width direction of the medium.

17. The image forming apparatus according to claim 16, wherein the at least one second detection unit includes two second detection units, and wherein the two second detection units are disposed at two respective positions which are opposite to each other with the first detection unit interposed therebetween, in the width direction.

18. A non-transitory computer readable medium storing a program causing a computer of an image forming apparatus to execute a process, the image forming apparatus including a first detection unit that receives first reflected light reflected from a first region irradiated with first irradiation light and that detects a signal indicating the amount of the first reflected light, and a second detection unit that receives second reflected light reflected from a second region irradiated with second irradiation light having an irradiation range smaller than an irradiation range of the first irradiation light and that detects a signal indicating the amount of the second reflected light, the process comprising:

forming a plurality of first images having a predetermined length in a predetermined direction, in a first portion of a medium moving in the predetermined direction, the first portion passing through the first region, the plurality of first images being configured in such a manner as to be spaced apart from each other at predetermined first intervals in the predetermined direction;

forming a plurality of second images having a length in the predetermined direction which is shorter than the length of the plurality of first images, in a second portion of the medium, the second portion passing through the second region, the plurality of second images being configured in such a manner as to be spaced apart from each other at second intervals shorter than the first intervals in the predetermined direction;

forming a third image used to specify density deviation amounts by using a predetermined density as a reference, in the first portion;

specifying a misregistration amount of the plurality of first images formed in the first portion, on the basis of the signal detected by the first detection unit when the plurality of first images pass through the first region;

specifying a misregistration amount of the plurality of second images formed on the second portion, on the basis of the signal detected by the second detection unit when the plurality of second images pass through the second region; and specifying the density deviation amounts on the basis of the signal detected by the first detection unit when the third image passes through the first region.

19. An image forming method comprising:

receiving first reflected light reflected from a first region irradiated with first irradiation light and detecting a first signal indicating the amount of the first reflected light;

receiving second reflected light reflected from a second region irradiated with second irradiation light having an irradiation range smaller than an irradiation range of the first irradiation light, and detecting a second signal indicating the amount of the second reflected light;

forming a plurality of first images having a predetermined length in a predetermined direction, in a first portion of a medium moving in the predetermined direction, the first portion passing through the first region, the plurality of first images being configured in such a manner as to be spaced apart from each other at predetermined first intervals in the predetermined direction;

forming a plurality of second images having a length in the predetermined direction which is shorter than the length of the plurality of first images, in a second portion of the medium, the second portion passing through the second region, the plurality of second images being configured in such a manner as to be spaced apart from each other at second intervals shorter than the first intervals in the predetermined direction;

forming a third image used to specify density deviation amounts by using a predetermined density as a reference, in the first portion;

specifying a misregistration amount of the plurality of first images formed in the first portion, on the basis of the first signal when the plurality of first images pass through the first region;

specifying a misregistration amount of the plurality of second images formed on the second portion, on the basis of the second signal when the plurality of second images pass through the second region; and specifying the density deviation amounts on the basis of the first signal when the third image passes through the first region.

* * * * *